United States Patent [19]

MacGregor

[11] 3,969,108

[45] July 13, 1976

[54] RECOVERY OF GALLIUM

[75] Inventor: John James MacGregor, London, England

[73] Assignee: Johnson Matthey & Co., Limited, London, England

[22] Filed: Sept. 10, 1975

[21] Appl. No.: 612,025

[30] Foreign Application Priority Data

Sept. 25, 1974 United Kingdom ..... 41688/74

[52] U.S. Cl. ..... 75/101 R; 75/109; 75/121; 423/131

[51] Int. Cl.[2] ..... C22B 58/00

[58] Field of Search ..... 75/101 R, 109, 121; 423/131

[56] References Cited

UNITED STATES PATENTS

| | | | |
|---|---|---|---|
| 2,325,176 | 7/1943 | Deitz | 75/121 |
| 3,170,857 | 2/1965 | Dotzer | 75/121 X |
| 3,248,212 | 4/1966 | Mellgren et al. | 75/101 R |
| 3,890,427 | 6/1975 | Dewey et al. | 423/131 X |
| 3,927,172 | 12/1975 | Stevens | 423/131 X |

*Primary Examiner*—G. Ozaki

*Attorney, Agent, or Firm*—Cushman, Darby & Cushman

[57] ABSTRACT

This invention relates to the recovery of gallium from scrubber dust containing aluminum and fluoride. In carrying out the process of the invention gallium is recovered from a particulate solid of the basic material by means of a process comprising the following steps:

a. preparing a mixture of the solid with an excess of an alkali;
b. sintering the said mixture;
c. leaching the sintered product obtained with an aqueous solution;
d. cementation of the gallium present in the resulting squeous solution with a metal more electropositive than gallium; and
e. collecting the solid gallium precipitate obtained by cementation.

7 Claims, No Drawings

RECOVERY OF GALLIUM

This invention relates to the recovery of gallium from scrubber dust containing aluminium and fluoride.

The scrubber dust in question is removed from a fume extraction system in plants operating the electrolytic process for the production of aluminium from Bauxite-Cryolite mixtures and may contain major proportions of aluminium and fluoride and gallium at a level of approximately 0.2% by weight.

It is an object of the present invention to recover gallium from this dust, and more particularly, it is an object to recover gallium by a process which does not involve the production of the highly poisonous HF vapour.

According to the present invention, a process for the recovery of gallium from a particulate solid comprises the following steps:

a. preparing a mixture of the solid with an excess of an alkali;
b. sintering the said mixture;
c. leaching the sintered product obtained with an aqueous solution;
d. cementation of the gallium present in the resulting aqueous solution with a metal more electropositive than gallium; and
e. collecting the gallium precipitate obtained by cementation.

Preferably, in step (a), the alkali used is sodium carbonate but may be potassium carbonate, sodium hydroxide, potassium hydroxide or a similar alkali. Preferably, also, sintering in step (b) is carried out in air at a temperature within the range 500°C – 800°C for a time in excess of ten minutes. Conveniently, the sintered product is leached with water and the gallium is cemented from the aqueous product with coarse aluminium filings.

EXAMPLE

The dust obtained from a fume extraction scrubber system of a plant operating the electrolytic production of aluminium was mixed with five times its weight of particulate sodium carbonate and sintered in air at 700°C for half an hour. The product was leached with water, filtered and cemented by contact with coarse aluminium filings. The precipitated gallium so obtained was collected and found to total approximately 70% of the gallium present in the original dust.

What we claim is:

1. A process for the recovery of gallium from a particulate solid, which process comprises the following steps:

a. preparing a mixture of the solid with an excess of an alkali;
b. sintering the said mixture;
c. leaching the sintered product obtained with an aqueous solution;
d. cementation of the gallium present in the resulting aqueous solution with a metal more electropositive than gallium; and
e. collecting the gallium precipitate obtained by cementation.

2. A process according to claim 1, wherein the alkali used in step (a) is sodium carbonate.

3. A process according to claim 1, wherein the alkali used in step (a) is potassium carbonate, sodium hydroxide or potassium hydroxide.

4. A process according to claim 3, wherein the sintering of step (b) is carried out at a temperature of 500° to 800°C in air.

5. A process according to claim 4, wherein sintering is carried out for at least ten minutes.

6. A process according to claim 5, wherein the leaching of step (c) is carried out in water.

7. A process according to claim 6, wherein the gallium is cemented from the aqueous product with aluminum filings.

* * * * *